US007234796B2

(12) United States Patent
Inoue

(10) Patent No.: US 7,234,796 B2
(45) Date of Patent: Jun. 26, 2007

(54) INKJET RECORDING METHOD AND APPARATUS

(75) Inventor: Seiichi Inoue, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 377 days.

(21) Appl. No.: 11/019,423

(22) Filed: Dec. 23, 2004

(65) Prior Publication Data

US 2005/0195244 A1 Sep. 8, 2005

(30) Foreign Application Priority Data

Dec. 24, 2003 (JP) ..... 2003-426442

(51) Int. Cl.
*B41J 2/06* (2006.01)

(52) U.S. Cl. ..... 347/55; 347/54

(58) Field of Classification Search ..... 347/54, 347/55, 103, 111–112, 120, 123, 127, 129; 399/273, 290, 293–295
See application file for complete search history.

(56) References Cited

U.S. PATENT DOCUMENTS 6,158,844 A * 12/2000 Murakami et al. ..... 347/55

FOREIGN PATENT DOCUMENTS

JP 10-230608 A 9/1998

* cited by examiner

*Primary Examiner*—Juanita D. Stepehns
(74) *Attorney, Agent, or Firm*—Sughrue Mion, PLLC

(57) ABSTRACT

The inkjet recording method and apparatus eject ink droplets made of an ink composition on a recording medium to record. The method and apparatus use insulating ink prepared by dispersing colorant particles capable of being charged in a solvent as the ink composition, allow an electrostatic force to act on the ink composition to form a thread of the ink composition and provide a stimulus to the thread at a frequency in a range of 100 kHz to 800 kHz to separate the thread into the ink droplets. The apparatus includes an inkjet head for ejecting the ink droplets, an electrode substrate for applying a charging voltage to the recording medium and a stimulus providing unit for providing the stimulus.

12 Claims, 5 Drawing Sheets

INKJET RECORDING METHOD AND APPARATUS

This application claims priority on Japanese patent application No. 2003-426442, the entire contents of which are hereby incorporated by reference. In addition, the entire contents of literatures cited in this specification are incorporated by reference.

BACKGROUND OF THE INVENTION

The present invention relates to an electrostatic inkjet recording method and apparatus for ejecting an ink composition using an electrostatic field. More specifically, the present invention relates to an inkjet recording method and apparatus for a high resolution capable of stably ejecting fine ink droplets.

According to electrostatic inkjet recording, a predetermined voltage is applied to each ejection portion of an inkjet head in accordance with image data, using an ink composition (hereinafter, simply referred to as ink) prepared by dispersing charged colorant particles in a dispersion medium, whereby the ejection of ink is controlled using an electrostatic force, and an image corresponding to image data is recorded on a recording medium. As a recording apparatus adopting the electrostatic inkjet recording, for example, JP 10-230608 A discloses an inkjet recording apparatus that ejects ink from a surface of a flat insulating substrate in a direction normal to the surface.

FIG. 6 shows a conceptual diagram of the inkjet recording apparatus disclosed by JP 10-230608 A during ejection of an ink droplet R. An inkjet head 80 includes a head substrate 82, ink guides 84, an insulating substrate 86, control electrodes 88, a counter electrode 90, a DC bias voltage source 92, and a pulse voltage source 94.

In the insulating substrate 86, nozzles (through-holes) 96 for ejecting ink are formed. The head substrate 82 is provided in an arrangement direction of the nozzles 96, and the ink guides 84 are disposed on the head substrate 82 at positions corresponding to the through-holes. The ink guides 84 extend through the nozzles 96, and each tip end portion 84*a* protrudes upward from the surface of the insulating substrate 86 on a recording medium P side. Each ink guide 84 is provided with a slit-shaped ink guide groove 83 in a vertical direction in the figure, and an ink composition is guided to the tip end of the ink guide groove 83 by a capillary phenomenon.

The insulating substrate 86 is placed at a predetermined distance from the head substrate 82, and a flow path of ink Q is formed therebetween.

The ink Q containing fine particles (colorant particles) charged in the same polarity as that of a voltage to be applied to the control electrodes 88 circulates in an ink flow path 98, for example, from the right side to the left side in the figure owing to a circulation mechanism of ink (not shown), whereby ink is supplied to each nozzle 96.

The control electrodes 88 are provided in a ring shape so as to surround the circumference of each nozzle 96 on the surface of the insulating substrate 86 on the recording medium P side. Furthermore, the control electrodes 88 are connected to the pulse power source 94 generating a pulse voltage in accordance with image data, and the pulse power source 94 is grounded via the DC bias power source 92.

Furthermore, the counter electrode 90 is placed at a predetermined distance from the tip ends of the ink guides 84 and grounded. The recording medium P is held on the counter electrode 90 so as to be opposed to the tip end portions 84*a* of the ink guides 84.

In such electrostatic inkjet recording, under the condition that only a bias voltage is applied to the control electrodes 88 by the DC bias power source 92, the Coulomb attraction with respect to the charged particles (charged particles, colorant particles) in ink, ink viscosity, surface tension, repulsion force between charged particles, fluid pressure in ink supply, and the like act on each other owing to the bias voltage, whereby ink rises slightly at the ink guide tip end to form meniscus.

Furthermore, the charged particles migrate to move to the vicinity of the meniscus by virtue of the Coulomb attraction and the like. That is, ink is concentrated.

When the pulse voltage (control voltage) by the pulse power source 94 is applied to the control electrodes 88, and an ejection ON state is established, a pulse voltage is superimposed on a bias voltage. Consequently, the ink Q present at the tip end of the ink guide is attracted to the recording medium P (counter electrode) side to allow meniscus to glow into a substantially conical shape, a so-called Taylor cone.

When a predetermined period of time elapses after the start of the application of a voltage, the Coulomb attraction acting on the charged particles and the surface tension of a dispersion medium become out of balance. Consequently, ink is ejected and flies toward the recording medium P as droplets, and attracted to the recording medium P side.

In the electrostatic inkjet recording, generally, a pulse voltage is modulated and applied to each control electrode 88 to control ejection ON/OFF, whereby ink droplets are modulated to be ejected, and on-demand ejection of ink droplets in accordance with an image to be recorded is performed. Thus, a desired image is formed on the recording medium P.

The inventor of the present invention has studied the ejection principle of such electrostatic inkjet recording, and found the following. As described above, when a pulse voltage (control voltage) is applied to the control electrode 88, meniscus grows at the tip end of the ink guide. Furthermore, when a finite time elapses, a large electrostatic force acts on the meniscus tip end portion with the highest electric field intensity, and the Coulomb force mainly acting on particles and the surface tension acting on the solvent become out of balance. At this time, a narrow liquid column with a diameter of about several μm to tens of μm called a thread extending toward a recording medium is formed. Then, when a finite time further elapses, the thread is separated in the middle into droplets, which are ejected toward the recording medium. Since the diameter of the thread is very small, the droplets formed by the separation of the thread are very minute. Thus, fine dots of about 10 μm can be formed on the recording medium.

Furthermore, the inventor has also found that the separation of the thread occurs at a frequency higher than a driving frequency of a pulse voltage for ejecting ink. That is, the separation of the thread continuously occurs a plurality of times within the time when a pulse voltage is applied once. Thus, one dot on the recording medium is formed of fine droplets ejected after the separation of the thread.

When one attempts to realize a higher resolution, it is desired to stably perform the formation and separation of the thread to stably form fine droplets. However, the formation and separation of the thread are based on a very complicated mechanism. Therefore, there is a possibility that until the thread is formed, the diameter and length of the thread, the separation position of the thread, and the like may vary.

Those variations are considered to vary a dot diameter or a dot shape, and to cause the degradation of an image.

SUMMARY OF THE INVENTION

The present invention has been achieved in view of the above, and an object of the invention is to provide an inkjet recording method capable of forming an image with a high resolution by stably forming and separating a thread.

Another object of the invention is to provide an inkjet recording apparatus to which the inkjet recording method is applied.

In order to attain the first object described above, the first aspect of the invention provides an inkjet recording method in which droplets made of an ink composition are ejected to record on a recording medium, comprising the steps of using insulating ink prepared by dispersing colorant particles capable of being charged in a solvent as the ink composition, allowing an electrostatic force to act on the ink composition to form a thread of the ink composition, and providing a stimulus to the thread at a frequency in a range of 100 kHz to 800 kHz to separate the thread into the droplets.

Preferably, an equation: $f=v/\{8.89\times a\times(1+3\eta/(2\sigma\rho a)^{(1/2)})^{(1/2)}\}$ is satisfied assuming that the frequency is f[Hz], a fly speed of the droplets is v[m/s], a radius of the thread is a[m], a viscosity of the ink composition is η[Pa·s], a surface tension of the ink composition is σ[N/m], and a density of the ink composition is ρ[kg/m$^3$].

Preferably, the stimulus comprises vibrations generated by using one of a piezoelectric element, a magnetostrictor, and an electrostatic actuator.

Preferably, the stimulus comprises heating with a heater that generates heat periodically.

Preferably, the stimulus comprises application of a high-frequency voltage at the frequency so that the high-frequency voltage is superimposed on one of a control voltage applied for controlling ejection of the droplets and a charging voltage applied for charging the recording medium with an opposite polarity to that of the control voltage.

Preferably, when at least two kinds of ink compositions that are different from each other are used as the ink composition, physical properties of the at least two kinds of ink compositions are previously adjusted so that frequencies of the stimulus becomes identical.

In order to attain the second object described above, the second aspect of the invention provides an inkjet recording apparatus in which an electrostatic force is allowed to act on an ink composition to eject ink droplets, thereby recording on a recording medium, comprising an inkjet head which is placed at a position where the inkjet head is opposed to the recording medium, and which includes ejection ports through which the ink droplets are ejected and control electrodes for applying control voltages for allowing the ink droplets to be ejected an electrode substrate placed on a side of the recording medium opposite to a side facing the inkjet head, for applying a charging voltage with a polarity opposite to that of the control voltages to the recording medium, and stimulus providing means for providing a stimulus at a frequency in a range of 100 kHz to 800 kHz to threads of the ink composition formed from the ejection ports toward the recording medium by electric forces generated from the control electrodes.

Preferably, the stimulus providing means provides the stimulus at the frequency f[Hz] satisfying an equation: $f=v/\{8.89\times a\times(1+3\eta/(2\sigma\rho a)^{(1/2)})^{(1/2)}\}$ where a fly speed at which the ink droplets fly from one of the ejection ports is v[m/s], a radius of one of the threads formed from the one of the ejection ports is a[m], a viscosity of the ink composition is η[Pa·s], a surface tension of the ink composition is σ[N/m], and a density of the ink composition is ρ[kg/m$^3$].

Preferably, the stimulus providing means comprises one of a piezoelectric element, a magnetostrictor, and an electrostatic actuator provided in the inkjet head.

Preferably, the stimulus providing means comprises a heater that generates heat periodically.

Preferably, the stimulus providing means comprises a high-frequency power source for applying a voltage at the frequency so that the voltage is superimposed on one of the control voltages and the charging voltage.

Preferably, the inkjet head includes respective ink guides extending through the ejection ports.

According to the inkjet recording method of the present invention, a thread formed by an electrostatic force can be separated stably, so that fine droplets can be ejected stably. Consequently, recording can be performed with minute dots and a high gray scale.

Furthermore, when a frequency f[Hz] (hereinafter, referred to as a Rayleigh-Weber frequency) satisfying the equation:

$$f=v/\{8.89\times a\times(1+3\eta/(2\sigma\rho a)^{(1/2)})^{(1/2)}\}$$

(where the fly speed of droplets is v[m/s], the radius of a thread is a[m], the viscosity of an ink composition is η[Pa·s], the surface tension of the ink composition is σ[N/m], and the density of the ink composition is ρ[kg/m$^3$]) is applied to a thread, the resonance of the control electrodes with respect to an electrostatic force occurs to increase an amplitude in a portion where the thread is formed, whereby the thread can be separated stably. This enhances the precision of gray-scale control and image quality.

Furthermore, according to the present invention, in the case where ink of two or more kinds of colors is used, the physical properties of each ink is adjusted in such a manner that the above-mentioned Rayleigh-Weber frequency becomes the same, and hence the thread of ink of each color can be separated into droplets under the same condition merely by providing a stimulus of the same Rayleigh-Weber frequency. Therefore, it becomes easy to control the gray scale of each color and the image quality of each color can be enhanced.

Furthermore, according to the present invention, since a stimulus is provided periodically, the adhesion of colorant particles in ink to the surface of a head and the like, and the clogging of the colorant particles in the nozzles can be reduced.

Furthermore, in the case where ink having thixotropy is used in the inkjet recording method of the present invention, when vibrations are caused as a periodic stimulus, the viscosity of ink decreases. Therefore, even when an ejection voltage applied to eject ink is lowered, ink droplets can be ejected satisfactorily. Thus, the ejection voltage can be reduced.

Furthermore, the inkjet recording apparatus of the present invention can provide a stimulus at a predetermined frequency to a thread by using stimulus providing means. Therefore, the inkjet recording apparatus of the present invention is suitable as an apparatus for implementing the inkjet recording method of the present invention for stably separating a thread and stably ejecting minute droplets.

DESCRIPTION OF THE PREFERRED EMBODIMENTS

Hereinafter, the inkjet recording method and apparatus of the present invention will be described in detail by way of preferred embodiments shown in the attached drawings. It should be noted that the present invention is not limited thereto.

Figure 1A:
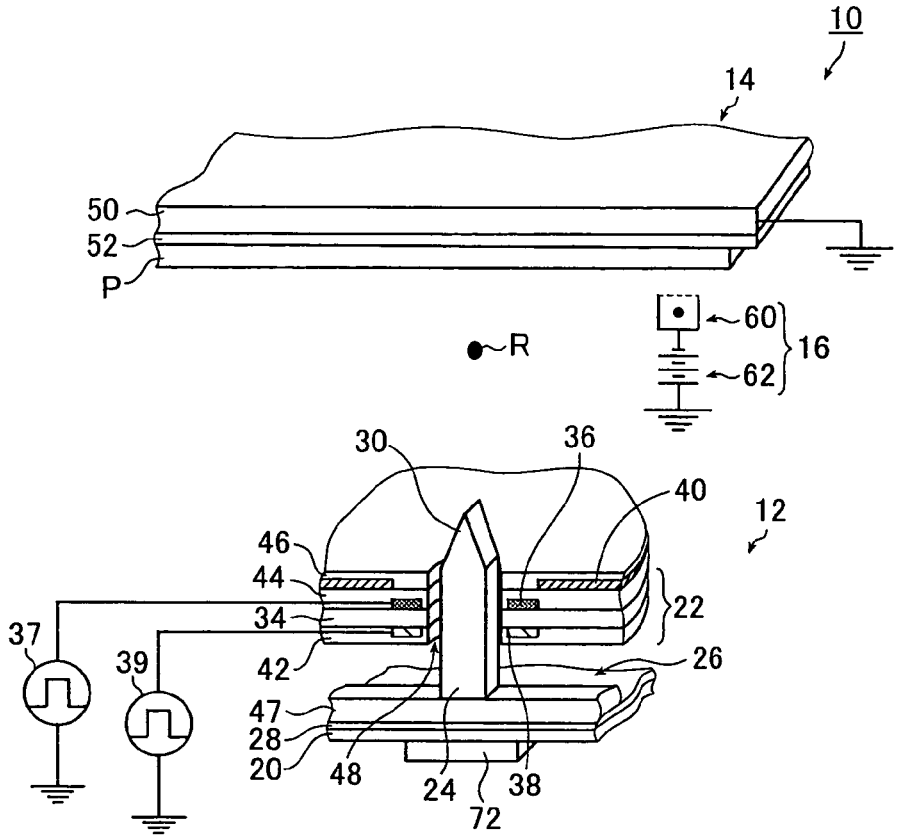
FIGS. 1A and 1B are a partial cross-sectional perspective view and a partial cross-sectional view each conceptually showing an exemplary inkjet recording apparatus for implementing an inkjet recording method of the present invention.
Figure 1B:
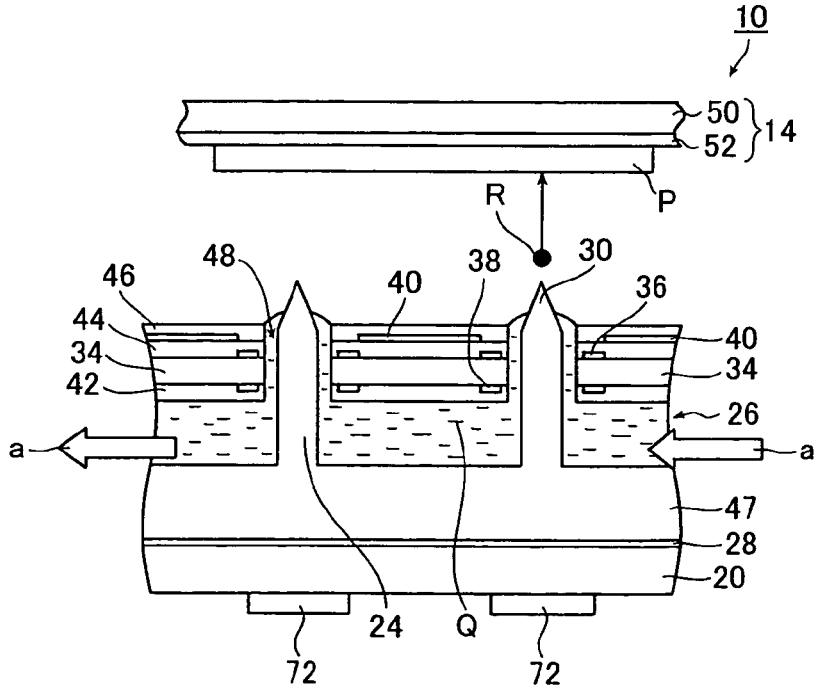

FIGS. 1A and 1B show conceptually an example of an electrostatic inkjet recording apparatus for implementing the inkjet recording method of the present invention. FIG. 1A is a (partial cross-sectional) perspective view, and FIG. 1B is a partial cross-sectional view. In order to facilitate the description, FIG. 1A shows only one ejection portion of an inkjet head of a multi-channel structure in which a large number of ejection portions are arranged two-dimensionally as shown in FIGS. 2A to 2C, and FIG. 1B shows only two ejection portions.

An inkjet recording apparatus (hereinafter, referred to as a recording apparatus) 10 shown in FIGS. 1A and 1B includes an inkjet head (hereinafter, referred to as a head) 12, holding means 14 of a recording medium P, and a charging unit 16. In the recording apparatus 10, after the recording medium P is charged to a bias electric potential by the charging unit 16, the head 12 and the holding means 14 are moved relatively under the condition that the head 12 is opposed to the recording medium P, and each ejection portion of the head 12 is driven by modulation in accordance with an image to be recorded to eject an ink droplet R on demand, whereby an intended image is recorded on the recording medium P.

The head 12 is an electrostatic inkjet head for allowing an electrostatic force to act on ink Q prepared by dispersing charged particles (colorant particles) containing a colorant in a carrier liquid (dispersion medium), thereby ejecting ink droplets R. The head 12 includes a head substrate 20, a nozzle substrate 22, ink guides 24, and piezoelectric elements 72 as stimulus providing means.

Furthermore, the head substrate 20 and the nozzle substrate 22 are opposed to each other at a predetermined distance, and an ink flow path 26 for supplying the ink Q to each ejection portion is formed therebetween. The ink Q contains colorant particles charged in the same polarity as that of a control voltage to be applied to first control electrodes 36 and second control electrodes 38. During recording, the ink Q circulates in the ink flow path 26 at a predetermined speed (e.g., ink flow of 200 mm/s) in a predetermined direction.

The head substrate 20 is a sheet-shaped insulating substrate common to all the ejection portions, and a floating conductive plate 28 in an electrically floating state is provided on the surface of the head substrate 20. In the floating conductive plate 28, an induced voltage induced in accordance with a voltage value of a control voltage to be applied to the control electrodes of the ejection portions (described later) is generated during recording of an image. Furthermore, a voltage value of the induced voltage automatically varies in accordance with the number of operation channels. Owing to the induced voltage, the colorant particles in the ink Q in the ink flow path 26 are biased to migrate to the nozzle substrate 22 side. That is, ink in nozzles 48 (described later) is concentrated more appropriately.

The floating conductive plate 28 is not an indispensable constituent element, and is preferably provided as appropriate. Furthermore, the floating conductive plate 28 may be disposed on a side closer to the head substrate 20 than the ink flow path 26, and for example, may be disposed in the head substrate 20. Furthermore, it is preferable that the floating conductive plate 28 be disposed on an upstream side of the ink flow path 26 with respect to the position where the ejection portions are placed. Furthermore, a predetermined voltage may be applied to the floating conductive plate 28.

On the other hand, the nozzle substrate 22 is a sheet-shaped insulating substrate common to all the ejection portions in a similar manner to the head substrate 20. The nozzle substrate 22 includes an insulating substrate 34, first control electrodes 36, second control electrodes 38, guard electrodes 40, and insulating layers 42, 44, and 46. Furthermore, the nozzles 48 serving as ejection ports of ink pass through the nozzle substrate 22 at positions corresponding to the respective ink guides 24.

As described above, the nozzle substrate 22 is placed at a distance from the head substrate 20, and the ink flow path 26 is formed therebetween.

The first control electrodes 36 and the second control electrodes 38 are circular electrodes provided in a ring shape so as to surround the circumferences of the nozzles 48 corresponding to the respective ejection portions, respectively on an upper surface and a lower surface in the figure of the insulating substrate 34. The first control electrodes 36 and the second control electrodes 38 are not limited to the circular electrodes in a ring shape. As long as they are disposed so as to be adjacent to the ink guides 24, electrodes in any shape such as substantially circular electrodes, divided circular electrodes, parallel electrodes, and substantially parallel electrodes can be used. The first control electrodes 36 and the second control electrodes 38 are connected to pulse power sources 37 and 39 for applying a pulse voltage respectively to the first control electrodes 36 and the second control electrodes 38.

The upper surfaces of the insulating substrate 34 and the first control electrodes 36 are covered with the insulating layer 44 for protecting and flattening the surfaces, and similarly, the lower surfaces of the insulating substrate 34 and the second control electrodes 38 are covered with the insulating layer 42 for protecting and flattening the surfaces.

Figure 2A:
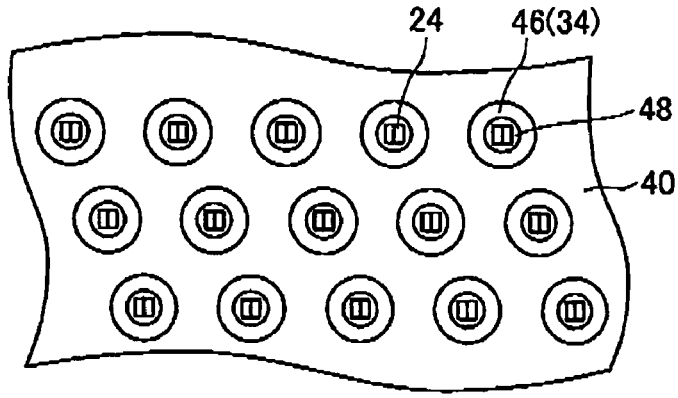
FIG. 2A is a diagram illustrating the arrangement of ejection portions of the inkjet recording apparatus shown in FIGS. 1A and 1B.
Figure 2B:
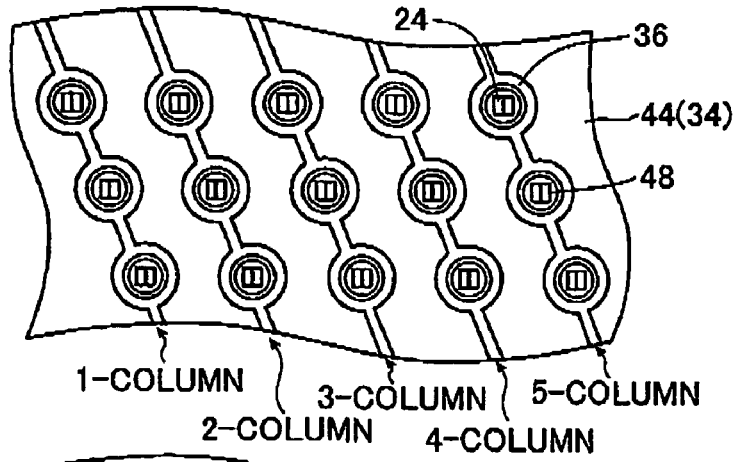
FIG. 2B is a diagram illustrating the arrangement of first control electrodes.
Figure 2C:
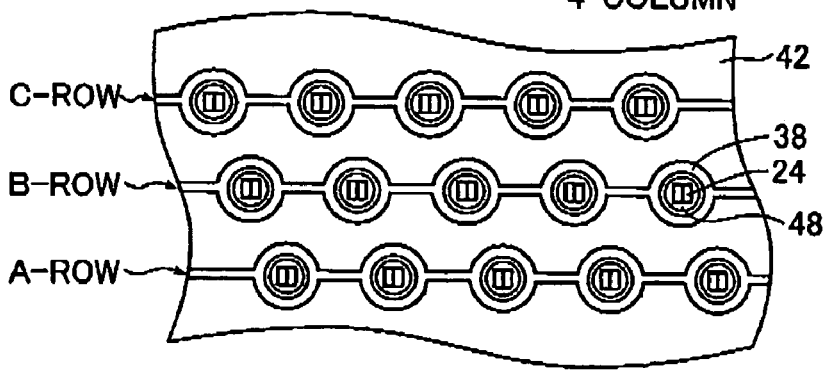
FIG. 2C is a diagram illustrating the arrangement of second control electrodes.

FIGS. 2A to 2C respectively show the arrangement of the ejection portions of the head 12, the arrangement of the first control electrodes 36, and the arrangement of the second control electrodes 38.

As shown in FIG. 2A, in the head 12, the respective ejection portions composed of the ink guides 24, the first control electrodes 36, the second control electrodes 38, the nozzles 48, and the like are arranged two-dimensionally in a matrix. FIGS. 2A to 2C show that 15 ejection portions are arranged in a matrix in 3 rows (A-row, B-row, C-row) in a column direction (main scanning direction) and 5 columns (1-column, 2-column, 3-column, 4-column, 5-column) in a row direction (sub-scanning direction).

As shown in FIG. 2B, the first control electrodes 36 of the ejection portions arranged in the same column are connected to each other. Furthermore, as shown in FIG. 2C, the second control electrodes of the ejection portions arranged in the same row are connected to each other.

Furthermore, as described with reference to FIG. 1A, the first control electrodes 36 and the second control electrodes 38 are respectively connected to the pulse power sources 37 and 39 for outputting a pulse voltage (driving pulse voltage) for ejecting the ink droplets R (driving each electrode).

The ejection portions in each row are arranged at predetermined intervals in the row direction.

Furthermore, the ejection portions in the B-row are arranged at a predetermined distance in the column direction from the ejection portions in the A-row, and positioned between the ejection portions in the A-row and the ejection portions in the C-row in the row direction. Similarly, the ejection portions in the C-row are arranged at a predetermined distance in the column direction from 5 ejection portions in the B-row, and positioned in the row direction between the ejection portions in the B-row and the ejection portions in the A-row. Thus, by placing the ejection portions included in the respective rows A, B, and C so that they are shifted in the row direction, one row for recording on the recording medium P is divided into three groups in the row direction.

During recording of an image, the first control electrodes 36 disposed in the same column are driven simultaneously at the same voltage level. Similarly, five second control electrodes 38 disposed in the same row are driven simultaneously at the same voltage level.

Furthermore, one row for recording on the recording medium P is divided in the row direction into three groups corresponding to the number of rows of the second control electrodes 38, whereby sequential driving in time division is performed. For example, in the case shown in FIGS. 2A to 2C, by sequentially recording in the A-row, the B-row, and the C-row of the second control electrodes 38 at a predetermined timing, one row of an image can be recorded on the recording medium P. Furthermore, in synchronization with this, the first control electrodes 36 are driven by pulse modulation in accordance with image data (image to be recorded), and the ejection of the ink droplets R is turned ON/OFF, whereby an image is recorded.

Thus, in the illustrated example, an image is recorded while the recording medium P and the head 12 are moved relatively in the column direction (main scanning direction), whereby an image can be recorded at a recording density that is three times as high as that of each row in the row direction (sub-scanning direction).

The control electrodes are not limited to a two-layered electrode structure composed of the first control electrodes 36 and the second control electrodes 38. They may have a single-layered electrode structure or a three or more layered electrode structure.

The guard electrode 40 is a sheet-shaped electrode common to all the ejection portions. As shown in FIG. 2A, portions corresponding to the first control electrodes 36 and the second control electrodes 38 formed on the circumferences of the nozzles 48 of the respective ejection portions are opened in a ring shape. Furthermore, the upper surfaces of the insulating layer 44 and the guard electrode 40 are covered with the insulating layer 46 for protecting and flattening the surfaces. A predetermined voltage is applied to the guard electrode 40, which plays a role of suppressing the interference of an electric field generated between the ink guides 24 of the adjacent ejection portions.

The guard electrodes 40 are not indispensable constituent elements. Furthermore, the nozzle substrate 22 may be provided with a shield electrode on the ink flow path 26 side with respect to the second control electrodes 38, so as to block a repulsion electric field from the first control electrodes 36 or the second control electrodes 38 to the ink flow path 26.

The ink guide 24 is a flat plate made of ceramic with a predetermined thickness having a convex tip end portion 30. In the illustrated example, the ink guides 24 of the ejection portions in the same row are arranged at predetermined intervals on the same support 47 placed on the floating conductive plate 28 on the head substrate 20. The ink guides 24 pass through the nozzles 48 formed in the nozzle substrate 22 so that tip end portions 30 protrude upward from an outermost surface (upper surface of the insulating layer 46 in FIG. 1A) on the recording medium P side of the nozzle substrate 22.

The tip end portions 30 of the ink guides 24 are molded in a substantially triangular shape (or a trapezoidal shape) that is tapered gradually toward the holding means 14 of the recording medium P.

It is preferable that metal be vapor-deposited on the tip end portions (endmost portions) 30. Although the metal vapor deposition of the tip end portions 30 is not an indispensable element, it substantially increases the dielectric constants of the tip end portions 30, and makes it easy to generate a strong electric field.

There is no particular limit to the shapes of the ink guides 24, as long as the colorant particles in the ink Q are allowed to migrate toward the tip end portions 30 (that is, the ink Q is concentrated). For example, the tip end portions 30 may be varied to an arbitrary shape (e.g., it may not be convex). Furthermore, in order to promote the concentration of ink, cutouts serving as ink guide grooves for guiding the ink Q to the tip end portions 30 by virtue of a capillary phenomenon may be formed in the vertical direction in the figure in the central portions of the ink guides 24.

The head 12 may be a so-called line head having an ejection portion column corresponding to the entire region of one side of the recording medium P. Alternatively, the head 12 may be a so-called shuttle-type head in which the scanning of the head 12 is combined with the intermittent transportation of the recording medium P.

The holding means 14 of the recording medium P has an electrode substrate 50 that functions as a back electrode and an insulating sheet 52, and is placed at a predetermined distance (e.g., 200 to 1000 μm) from the tip end portions 30 of the ink guides 24 so as to be opposed to the head 12.

The electrode substrate 50 is grounded, and the insulating sheet 52 is placed on the surface of the electrode substrate 50 on the ink guide 24 side. During recording, the recording medium P is held on the surface of the insulating sheet 52, that is, the holding means 14 (insulating sheet 52) functions as a platen of the recording medium P.

The charging unit 16 includes a scorotron charger 60 for charging the recording medium P to a negative high voltage and a bias voltage source 62 for supplying a negative high voltage to the scorotron charger 60.

The scorotron charger 60 is placed at a predetermined distance at a position opposed to the surface of the recording medium P. Furthermore, the terminal on a negative side of the bias voltage source 62 is connected to the scorotron charger 60, and the terminal on a positive side thereof is grounded.

The charging means of the charging unit 16 is not limited to the scorotron charger 60, and various kinds of known charging means such as a corotron charger and a solid charger can be used.

During recording of an image, the surface of the recording medium P on the insulating sheet 52 is charged to a predetermined negative high voltage (e.g., −1,500 V) with a polarity opposite to that of a high voltage to be applied to the first control electrodes 36 and the second control electrodes 38. Consequently, the recording medium P is biased to a negative high voltage with respect to the first control electrodes 36 or the second control electrodes 38, and is electrostatically attracted and adhere to the insulating sheet 52 of the holding means 14.

More specifically, in the illustrated recording apparatus 10, the recording medium P functions as a counter electrode in electrostatic inkjet recording.

In this embodiment, the holding means 14 is composed of the electrode substrate 50 and the insulating sheet 52, and the recording medium P is charged to a negative high voltage by the charging unit 16 to allow the recording medium P to be electrostatically attracted and adhere to the surface of the insulating sheet 52. However, the present invention is not limited thereto. The holding means 14 may be composed only of the electrode substrate 50, and the holding means 14 (electrode substrate 50) may be connected to the bias power source 62 to be always biased to a negative high voltage, whereby the recording medium P is electrostatically attracted and adhere to the surface of the electrode substrate 50.

Furthermore, the electrostatic attraction of the recording medium P to the holding means 14, and the application of a negative high bias voltage to the recording medium P or the application of a negative high bias voltage to the holding means 14 may be performed with separate negative high voltage sources, and the method of supporting the recording medium P by the holding means 14 is not limited to the electrostatic attraction of the recording medium P, and other supporting methods and supporting means may be used.

Next, stimulus providing means of the inkjet recording apparatus of the present invention will be described. In this embodiment, as shown in FIGS. 1A and 1B, the piezoelectric elements 72 as the stimulus providing means are provided coaxially with the nozzles 48 on the surface (bottom surface) opposite to the surface of the head substrate 20 where the ink guides 30 are formed. The piezoelectric elements 72 are respectively provided in the nozzles 48, and can oscillate at a frequency in the range of 100 kHz to 800 kHz. Furthermore, the piezoelectric elements 72 can oscillate continuously while the inkjet head 12 is driven.

In the present invention, a thread of an ink composition formed at the tip end of each ink guide 30 is supplied with a stimulus at a frequency in the range of 100 kHz to 800 kHz by the piezoelectric elements 72 as the stimulus providing means. The reason for limiting the range of a stimulus frequency to 100 kHz to 800 kHz is as follows. When the stimulus frequency to be supplied is less than 100 kHz, the droplets obtained have too large diameters and are not suitable for high resolution recording. When the stimulus frequency exceeds 800 kHz, the diameters of the droplets obtained become too small, which makes it necessary to use a number of droplets for forming one dot. For example, in the case where the inkjet head is driven with ink having predetermined physical property values, when the stimulus frequency is less than 100 kHz, the droplet diameter becomes about 15 μm, and the diameter of the dot formed on the recording medium exceeds 30 μm. The dot diameter in the case of recording at 1,200 dpi is 30 μm. Therefore, when the dot diameter exceeds 30 μm by using the stimulus frequency of less than 100 kHz, such a stimulus frequency is unsuitable for recording at 1,200 dpi or more. Thus, the stimulus frequency to be supplied is preferably 100 kHz or more.

Furthermore, when the stimulus frequency to be supplied exceeds 800 kHz in the case of driving the inkjet head with ink having predetermined physical property values in the same way as the above, the droplet diameter becomes about 7 μm. Assuming that recording is performed at a recording density of at least 1,200 dpi, a large number of droplets (i.e., 25 droplets) are required for forming one dot. In particular, the inkjet head ejects droplets during main scanning, so that the shape of a dot formed on the recording medium becomes an elongated ellipse instead of a circle, which is not preferable in terms of a high resolution. Furthermore, when the droplet diameter is about 7 μm or smaller, an air resistance during fly becomes dominant, that is, the droplets are likely to be influenced by the air resistance. Furthermore, after the droplets are ejected, a coupled motion is performed, so that the precision in the landing position decreases. In order to prevent this, the stimulus frequency to be supplied is preferably 800 kHz or less.

In this embodiment, the stimulus providing means is not limited to the piezoelectric element. For example, means for providing a stimulus mechanically, thermally, or electrically can be used. Any means can be used as the means for providing a stimulus mechanically as long as it can provide vibrations at a predetermined frequency (e.g., an ultrasonic wave) to a thread formed by the application of an electrostatic force to ink by the first control electrodes 36 and the second control electrodes 38. For example, an ultrasonic transducer, a vibrator, a magnetostrictor, or an electrostatic actuator can be used. The mechanical stimulus providing means can be formed at any position of the inkjet head, and is preferably provided on the back surface of the head substrate 20 in the vicinity of the nozzles 48.

The means for providing a stimulus thermally is not particularly limited as long as it can provide heat to a thread at a predetermined frequency. For example, a heater capable of generating heat periodically can be used. For example, in FIGS. 1A and 1B, an electric resistance wire (heating element) is provided as a heater in the vicinity of each of the nozzles 48 on the surface of the nozzle substrate 22, and for example, when a pulse voltage with a desired frequency is applied to these electric resistance wires, a thread can be heated periodically. Herein, each of the electric resistance wires is preferably configured using a material having resistance to corrosion by ink. Furthermore, the electric resistance wires are preferably provided in a ring shape so as to surround the circumferences of the nozzles 48. If such a heater is used, the electric resistance wires generate heat periodically at a predetermined frequency, so that the thread of ink formed by an electrostatic force due to the control electrodes can be supplied with heat periodically, whereby the thread can be separated efficiently.

Figure 5:
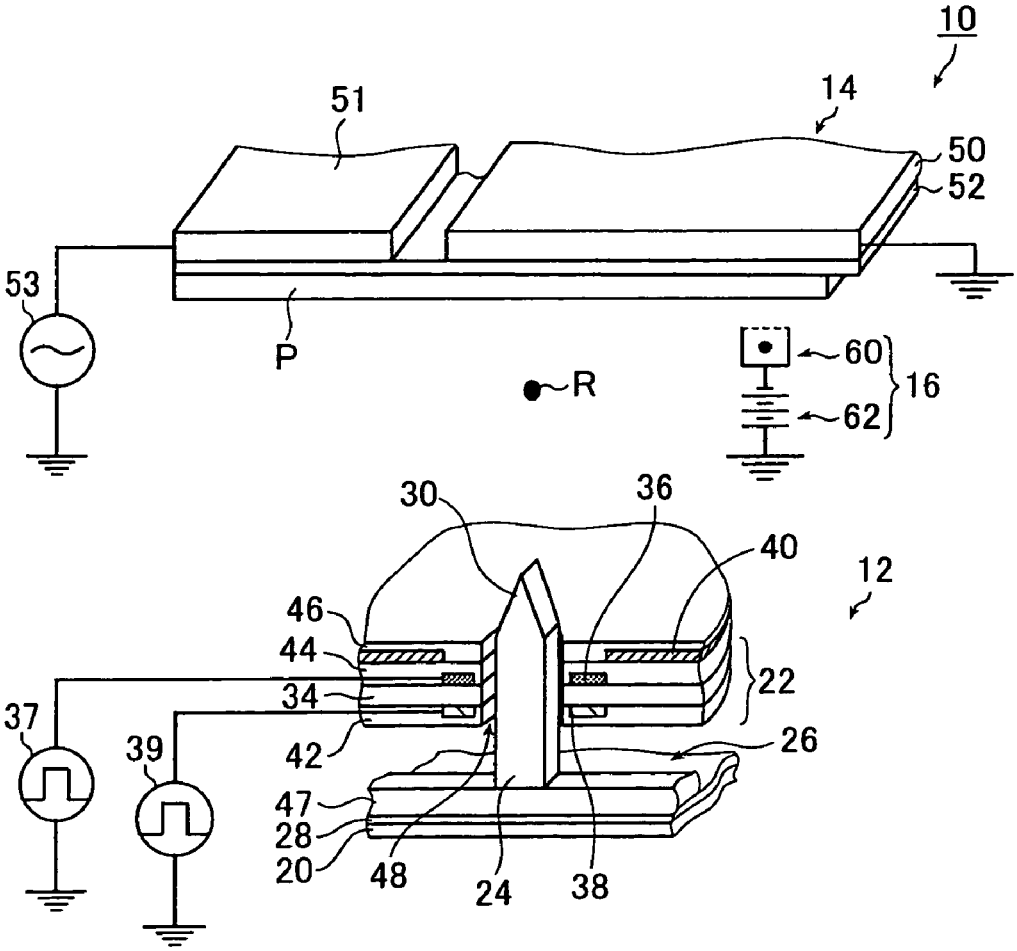
FIG. 5 is a conceptual diagram of the inkjet recording apparatus provided with a high-frequency AC power source that applies a high frequency so that the high frequency is superimposed on a bias voltage applied for charging a recording medium, and illustrates another embodiment of the inkjet recording apparatus shown in FIGS. 1A and 1B.
Figure 6:
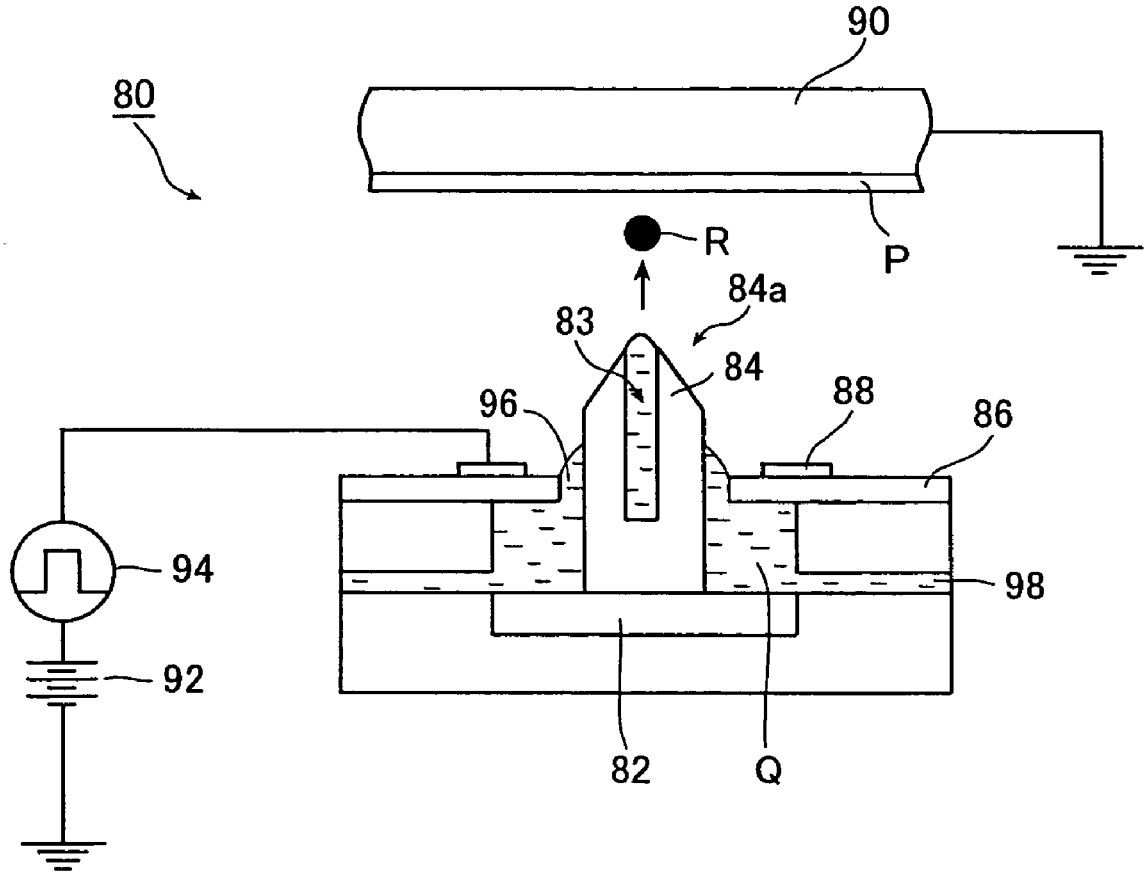
FIG. 6 PRIOR ART
FIG. 6 is a conceptual diagram illustrating conventional electrostatic inkjet recording.

Furthermore, for example, a high-frequency power source can be used as the means for providing a stimulus electrically, and a high frequency AC bias voltage from the high-frequency power source can be superimposed on a bias voltage (also referred to as a charging voltage) for charging the recording medium P, or a control voltage applied to at least one of the first control electrode 36 and the second control electrode 38. As the means for superimposing a high frequency voltage on a bias voltage, for example, as shown in FIG. 5, the electrode substrate 51 (second electrode substrate) is provided on a side of the recording medium P opposite to the side facing the head, separately from the electrode substrate 50 (first electrode substrate), and the high-frequency AC power source 53 connected to the second electrode substrate 51 can be provided. The second electrode substrate 51 is supplied with an AC bias voltage at a frequency in the range of 100 kHz to 800 kHz by the high-frequency AC power source 53. At this time, the surface potential of the recording medium P becomes a potential obtained by superimposing an AC bias voltage on a voltage previously charged by the charging unit. Therefore, the electric field formed between the nozzles of the head and the recording medium P changes periodically owing to the AC bias voltage. When the first control electrodes 36 and the second control electrodes 38 are supplied with a control voltage so that ink droplets are ejected from the nozzles, ink forming meniscus at the tip end of each ink guide 30 is drawn to form a thread by virtue of an electrostatic force. An electrostatic field varied periodically by an AC bias voltage is applied to the thread. Therefore, an amplitude increases owing to the resonance with respect to an electrostatic force by the first control electrodes 36 and the second control electrodes 38, whereby the thread is stably separated periodically into minute droplets. The AC bias voltage may have any shape as long as the frequency is in the range of 100 kHz to 800 kHz. For example, a sine wave, a rectangular wave, a triangular wave, a trapezoidal wave, or the like can be used.

Furthermore, an AC bias voltage with a high frequency in the range of 100 kHz to 800 kHz can be superimposed on a control voltage applied to at least one of the first control electrode 36 and the second control electrode 38, using a high-frequency AC power source. Because of this, an electrostatic force generated from the first control electrodes 36 or the second control electrodes 38 varies, so that resonance occurs in a portion where a thread is formed to increase a vibration amplitude, and the thread is separated stably into minute droplets.

Furthermore, regarding the effective voltage of the AC bias voltage, a voltage value at which ink droplets are not ejected from nozzles may be appropriately selected in the above-mentioned frequency range. The effective voltage is preferably 5 to 80% of the ejection voltage value, and more preferably 10 to 50% of the ejection voltage value. The reason for setting the effective voltage of the AC bias voltage in this range is as follows. When the effective voltage is too small, there is a possibility that a sufficient effect for separating a thread cannot be obtained when a stimulus at a frequency in the above-mentioned range is provided. Furthermore, when the effective voltage is too large, there is a possibility that ink droplets are ejected from the nozzles even under the condition that an ejection pulse voltage is turned off.

It is preferable that a frequency f of a stimulus generated by the stimulus providing means satisfy an equation:

$$f=v/\{8.89\times a\times(1+3\eta/(2\sigma\rho a)^{(1/2)})^{(1/2)}\},$$

where the fly speed of ink droplets is v[m/s], the radius of a thread is a[m], the viscosity of ink is η[Pa·s], the surface tension of the ink is σ[N/m], and the density of the ink is ρ[kg/m$^3$]. The frequency satisfying the above equation is also called a Rayleigh-Weber frequency. Controlling the oscillation so as to obtain this frequency enables a thread to be stably formed and separated.

For example, in the case where the frequency f of a stimulus generated by the stimulus providing means is specified at a predetermined frequency in terms of the performance of the stimulus providing means, the fly speed v of ink droplets is specified at a predetermined speed in terms of a recording speed, and the radius a of the thread is specified at a predetermined radius in terms of the formation of minute droplets and the increase in resolution, it is preferable to set the physical property values of an ink composition so as to satisfy the above equation. Alternatively, in the case where the physical property values of the ink composition to be used have already been specified, it is desirable to set the frequency f, the fly speed v of ink droplets, and the radius a of a thread so as to satisfy the above equation. More specifically, according to the present invention, it is desirable to adjust the frequency f, the fly speed v of ink droplets, the radius a of a thread, and the physical property values of an ink composition, if required, in terms of the performance of the stimulus providing means, the recording speed on a recording medium, the resolution, and the like.

The stimulus generated by the stimulus providing means may be provided continuously while the inkjet head is being driven, or may be provided only while droplets are being ejected from the nozzles, i.e., while a control voltage is being applied to the control electrodes or during a period from a time immediately before a control voltage is applied to a time at which the application of the control voltage is completed.

Furthermore, in the case of using a transducer, for example, as the stimulus providing means, it is desirable to adjust the oscillation frequency of the transducer in consideration of the material and shape of a head, the acoustic impedance due to ink, and the like.

Next, the ink Q (ink composition) used in the recording apparatus 10 will be described. The ink Q used in the present invention is an ink composition, which contains at least a dispersion medium, particles (colorant particles) containing at least a colorant, and a charge regulator for charging the colorant particles, the ink composition being prepared by dispersing the colorant particles (charged particles) charged by the charge regulator in the dispersion medium. A preferable example of the ink Q used in the present invention is as follows.

In the ink Q used in the present invention, it is preferable that the dispersion medium be an dielectric liquid having a high electric resistivity, in particular, $10^{10}$ Ωcm or more. When a dispersion medium having a low electric resistivity is used, adjacent ejection electrodes are brought into electric conduction, which is not suitable for the present invention.

Furthermore, the relative dielectric constant of the dispersion medium (dielectric liquid) is preferably 5 or less, more preferably 4 or less, and most preferably 3.5 or less. Setting the relative dielectric constant of the dispersion medium in this range enables an electric field to effectively act on the colorant particles (charged particles) in the dispersion medium, which is preferable.

Preferable examples of the dispersion medium include straight-chain or branched aliphatic hydrocarbons, alicyclic hydrocarbons and aromatic hydrocarbons, halogen substitution products of these hydrocarbons, and silicone oil.

Specific examples thereof include hexane, heptane, octane, isooctane, decane, isodecane, decalin, nonane, dodecane, isododecane, cyclohexane, cyclooctane, cyclodecane, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), KF-96L (a trade name of Shin-Etsu Chemical Co., Ltd.). They may be used singly or as a mixture of two or more thereof.

The content of the dispersion medium in the entire ink Q is preferably 20 to 99% by weight. Setting the content of the dispersion medium to be 20% by weight or more enables the colorant particles to be dispersed in the dispersion medium satisfactorily. Setting the content of the dispersion medium to be 99% by weight or less enables the content of the colorant particles to be sufficient.

In the ink Q used in the present invention, a known dye or pigment can be used as the colorant in the colorant particles, and is selected in accordance with the application and purpose.

For example, in terms of the color tone of an image recorded material (printed matter), a pigment is preferably used (for example, see "Pigment Dispersion Stabilization and Surface Treatment Technology Evaluation" issued by Technical Information Institute Co., Ltd., Dec. 25, 2001, 1st Edition. Hereinafter, referred to as a "reference document"). In particular, when a pigment used for offset printing ink and proof is used, a color tone similar to that of offset printed matter can be obtained, which is preferable.

Furthermore, in the ink Q used in the present invention, by changing a colorant to be used, ink of four colors of yellow, magenta, cyan, and black or other colors can be produced.

Examples of the pigment for the yellow ink include: monoazo pigments such as C.I. Pigment Yellow 1 and C.I. Pigment Yellow 74; dis azo pigments such as C.I. Pigment Yellow 12 and C.I. Pigment Yellow 17; non benzidine type azo pigments such as C.I. Pigment Yellow 180; azo lake pigments such as C.I. Pigment Yellow 100; condensed azo pigments such as C.I. Pigment Yellow 95; acid dye lake pigments such as C.I. Pigment Yellow 115; basic dye lake pigments such as C.I. Pigment Yellow 18; anthraquinone type pigments such as Flavanthrone Yellow; isoindolinone pigments such as Isoindolinone Yellow 3RLT; quinophthalone pigments such as Quinophthalone Yellow; isoindoline pigments such as Isoindoline Yellow; nitroso pigments such as C.I. Pigment Yellow 153; metal complex salt azomethine pigments such as C.I. Pigment Yellow 117; and isoindolinone pigments such as C.I. Pigment Yellow 139.

Examples of the pigment for the magenta ink include: monoazo pigments such as C.I. Pigment Red 3; dis azo pigments such as C.I. Pigment Red 38; azo lake pigments such as C.I. Pigment Red 53:1 and C.I. Pigment Red 57:1; condensed azo pigments such as C.I. Pigment Red 144; acid dye lake pigments such as C.I. Pigment Red 174; basic dye lake pigments such as C.I. Pigment Red 81; anthraquinone type pigments such as C.I. Pigment Red 177; thioindigo pigments such as C.I. Pigment Red 88; perinone pigments such as C.I. Pigment Red 194; perylene pigments such as C.I. Pigment Red 149; quinacridone pigments such as C.I. Pigment Red 122; isoindolinone pigments such as C.I. Pigment Red 180; and alizarin lake pigments such as C.I. Pigment Red 83.

Examples of the pigment for the cyan ink include: dis azo pigments such as C.I. Pigment Blue 25; phthalocyanine pigments such as C.I. Pigment Blue 15; acid dye lake pigments such as C.I. Pigment Blue 24; basic dye lake pigments such as C.I. Pigment Blue 1; anthraquinone type pigments such as C.I. Pigment Blue 60; and alkali blue pigments such as C.I. Pigment Blue 18.

Examples of the pigment for the black ink include: organic and iron oxide pigments such as Aniline black type pigments; and carbon black pigments such as Furnace Black, Lamp Black, Acetylene Black, and Channel Black.

Further, suitably applicable typical processed pigments include microlith pigments such as Microlith -A, -K, and -T. Specific examples thereof include Microlith Yellow 4G-A, Microlith Red BP-K, Microlith Blue 4G-T, and Microlith Black C-T.

Furthermore, the ink Q used in the present invention may be white ink using a calcium carbonate or titanium oxide pigment, silver ink using aluminum powder, gold ink using a copper alloy, or the like, as well as ink of each color of yellow, magenta, cyan, and black.

It is preferable that one kind of pigment be basically used for one color in terms of convenience of ink production. Alternatively, in order to adjust a color tone, it is preferable that at least two kinds be used (for example, phthalocyanine is mixed with carbon black for black ink). Furthermore, the pigment may be used after being subjected to surface treatment according to a known method, such as rosin treatment (see the above-mentioned reference document).

It is preferable that the content of a colorant with respect to the entire ink Q be 0.1 to 50% by weight. By setting the content of the pigment to be 0.1% by weight or more, the amount of the pigment becomes sufficient, and satisfactory color development can be obtained on printed matter. Furthermore, by setting the content of the pigment to be 50% by weight or less, particles containing a colorant can be dispersed in a dispersion medium satisfactorily. The content of the pigment with respect to the entire ink Q is more preferably 1 to 30% by weight.

In the ink Q used in the present invention, colorant particles may be obtained by dispersing (pulverizing) a colorant such as a pigment directly in a dispersion medium. Preferably, particles in which a colorant is covered with a covering agent are used as colorant particles and dispersed in a dispersion medium.

By covering a colorant with a covering agent, the charge of the colorant itself is shielded, whereby desirable charge characteristics can be provided. Furthermore, by using for the ink Q, colorant particles in which a colorant is covered with a covering agent, an image is recorded on a recording medium by electrostatic inkjet recording, followed by fixing by heating with a heat roller or the like, whereby the image can be stabilized.

Examples of the covering agent include rosins, rosin-modified phenol resins, alkyd resins, (meth)acrylic polymers, polyurethane, polyester, polyamide, polyethylene, polybutadiene, polystyrene, polyvinyl acetate, acetal modified polyvinyl alcohol, and polycarbonate.

Of those, in terms of the easiness of forming particles, a polymer having a weight-average molecular weight of 2,000 to 1,000,000, and a polydispersity (weight-average molecular weight/number-average molecular weight) of 1.0 to 5.0 is preferable. Furthermore, in terms of the easiness of fixing, a polymer having one of a softening point, a glass transition temperature, and a melting point in the range of 40° C. to 120° C. is preferable.

In the present invention, a polymer particularly suitably used as a covering agent is the one containing at least one of the constituent units represented by the following general formulae (1) to (4).

General formula (1)

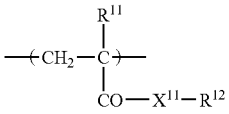

General formula (2)

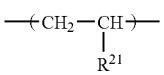

General formula (3)

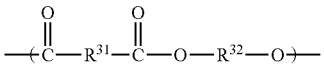

General formula (4)

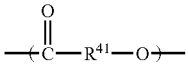

In the above-mentioned formulae, $X^{11}$ represents an oxygen atom or —N($R^{13}$)—. $R^{11}$ represents a hydrogen atom or a methyl group. $R^{12}$ represents a hydrocarbon group containing 1 to 30 carbon atoms, and $R^{13}$ represents a hydrogen atom or a hydrocarbon group containing 1 to 30 carbon atoms. $R^{21}$ represents a hydrogen atom or a hydrocarbon group containing 1 to 20 carbon atoms. $R^{31}$, $R^{32}$, and $R^{41}$ each represent a divalent hydrocarbon group containing 1 to 20 carbon atoms. The hydrocarbon group of $R^{12}$, $R^{21}$, $R^{31}$, $R^{32}$, or $R^{41}$ may contain an ether bond, an amino group, a hydroxy group, or a halogen substituent.

A polymer containing a constituent unit represented by the general formula (1) may be obtained by subjecting the corresponding radical polymerizable monomer to radical polymerization using any known method.

Examples of the radical polymerizable monomer used include: (meth)acrylates such as methyl (meth)acrylate, ethyl (meth)acrylate, propyl (meth)acrylate, butyl (meth) acrylate, hexyl (meth)acrylate, octyl (meth)acrylate, 2-ethylhexyl (meth)acrylate, dodecyl (meth)acrylate, stearyl (meth)acrylate, cyclohexyl (meth)acrylate, phenyl (meth) acrylate, benzyl (meth)acrylate, and 2-hydroxyethyl (meth) acrylate; and (meth)acrylamides such as N-methyl (meth) acrylamide, N-propyl (meth)acrylamide, N-phenyl (meth) acrylamide, and N,N-dimethyl (meth)acrylamide.

A polymer containing a constituent unit represented by the general formula (2) may be obtained by subjecting the corresponding radical polymerizable monomer to radical polymerization using any known method.

Examples of the radical polymerizable monomer used include ethylene, propylene, butadiene, styrene, and 4-methylstyrene.

A polymer containing a constituent unit shown in the general formula (3) may be obtained by subjecting the corresponding dicarboxylic acid or acid anhydride and diol to dehydration condensation using any known method.

Examples of the dicarboxylic acid and acid anhydride used include succinic anhydride, adipic acid, sebacic acid, isophthalic acid, terephthalic acid, 1,4-phenylene diacetic acid, and diglycolic acid. Further, examples of the diol used include ethylene glycol, 1,2-propanediol, 1,3-propanediol, 1,4-butanediol, 1,6-hexanediol, 1,10-decanediol, 2-butene-1,4-diol, 1,4-cyclohexanediol, 1,4-cyclohexanedimethanol, 1,4-benzenedimethanol, and diethylene glycol.

The polymer containing a constituent unit represented by the general formula (4) is obtained by subjecting a carboxylic acid having a corresponding hydroxy group to dehydration condensation by a known method, or by subjecting a cyclic ester of the carboxylic acid having a corresponding hydroxy group to ring-opening polymerization by a known method.

Examples of the carboxylic acid having a hydroxy group or its cyclic ester to be used include 6-hydroxyhexanoic acid, 11-hydroxyundecanoic acid, hydroxybenzoic acid, and γ-caprolactone.

The polymer containing at least one of the constituent units represented by the general formulae (1) to (4) may be a homopolymer of the constituent units represented by the general formulae (1) to (4), or a copolymer with other constituent components. Furthermore, each of those polymers may be used alone as a covering agent, or two or more kinds of them may be combined and used.

It is preferable that the content of the covering agent with respect to the entire ink Q be 0.1 to 40% by weight. By setting the content of the covering agent to be 0.1% by weight or more, the amount of the covering agent becomes sufficient, and sufficient fixing property can be obtained. By setting the content of the covering agent to be 40% by weight or less, colorant particles in which a colorant is covered with a covering agent can be formed satisfactorily.

In the ink Q used in the present invention, the above-mentioned colorant particles are dispersed (pulverized) in a dispersion medium. It is more preferable that the diameter of the particles be controlled, and a dispersant be used so as to suppress the precipitation of the colorant particles in a composition.

Suitably applicable dispersants include typical surfactants including sorbitan fatty acid ester such as sorbitan monooleate and polyethylene glycol fatty acid ester such as polyoxyethylene distearate. Further, examples thereof include: a copolymer of styrene and maleic acid, and an amine modified product thereof; a copolymer of styrene and a (meth)acryl compound; a (meth)acryl-based polymer; a copolymer of polyethylene and a (meth)acryl compound; rosin; BYK-160, 162, 164, and 182 (polyurethane-based polymers available from Byg Chemie Co.); EFKA-401 and 402 (acrylic polymers available from EFKA); and SOLSPERSE 17000 and 24000 (polyester-based polymers available from Zeneca). In the present invention, the dispersant is preferably a polymer having a weight-average molecular weight in the range of 1,000 to 1,000,000 and a polydispersity (weight-average molecular weight/number-average molecular weight) in the range of 1.0 to 7.0 in terms of long-term storage stability of the ink Q. Further, graft polymers or block polymers are used most preferably.

In the ink Q used in the present invention, a polymer particularly suitably used as the dispersant is a graft polymer containing at least a polymer component composed of at least one of the constituent units represented by the following general formulae (5) and (6), and a polymer component containing at least the constituent unit represented by the following general formula (7) as a graft chain.

General formula (5)

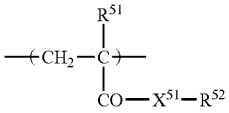

General formula (6)

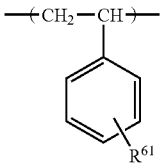

General formula (7)

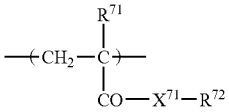

In the above formulae, $X^{51}$ represents an oxygen atom or —N($R^{53}$)—. $R^{51}$ represents a hydrogen atom or a methyl group, $R^{52}$ represents a hydrocarbon group containing 1 to 10 carbon atoms, and $R^{53}$ represents a hydrogen atom or a hydrocarbon group containing 1 to 10 carbon atoms. $R^{61}$ represents a hydrogen atom, a hydrocarbon group containing 1 to 20 carbon atoms, a halogen atom, a hydroxyl group, or an alkoxy group containing 1 to 20 carbon atoms. $X^{71}$ represents an oxygen atom or —N($R^{73}$)—. $R^{71}$ represents a hydrogen atom or a methyl group, $R^{72}$ represents a hydrocarbon group containing 4 to 30 carbon atoms, and $R^{73}$ represents a hydrogen atom or a hydrocarbon group containing 1 to 30 carbon atoms. The hydrocarbon group of $R^{52}$ or $R^{72}$ may contain an ether bond, an amino group, a hydroxy group, or a halogen substituent.

The above-mentioned graft polymer can be obtained by: polymerizing a radical polymerizable monomer corresponding to the general formula (7) preferably in the presence of a chain transfer agent; introducing a polymerizable functional group to terminals of the obtained polymer; and furthermore, copolymerizing the resultant monomer with a radical polymerizable monomer corresponding to the general formula (5) or (6).

Examples of the radical polymerizable monomer corresponding to the general formula (5) include: (meth)acrylates such as methyl (meth)acrylate, ethyl (meth)acrylate, propyl (meth)acrylate, butyl (meth)acrylate, hexyl (meth)acrylate, cyclohexyl (meth)acrylate, phenyl (meth)acrylate, benzyl (meth)acrylate, and 2-hydroxyethyl (meth)acrylate; and (meth)acrylamides such as N-methyl (meth)acrylamide, N-propyl (meth)acrylamide, N-phenyl (meth)acrylamide, and N,N-dimethyl (meth)acrylamide.

Examples of the radical polymerizable monomer corresponding to the general formula (6) include styrene, 4-methylstyrene, chlorostyrene, and methoxystyrene.

Further, examples of the radical polymerizable monomer corresponding to the general formula (7) include hexyl (meth)acrylate, octyl (meth)acrylate, 2-ethylhexyl (meth) acrylate, dodecyl (meth)acrylate, and stearyl (meth)acrylate.

The polymers represented by the following structural formulae may be given as specific examples of the graft polymers thereof.

[BZ-1]

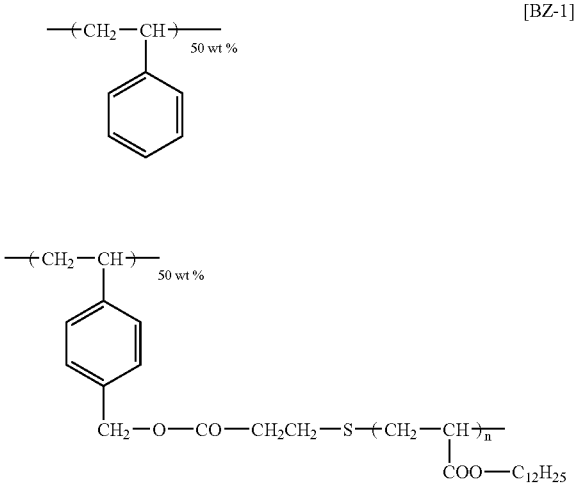

[BZ-2]

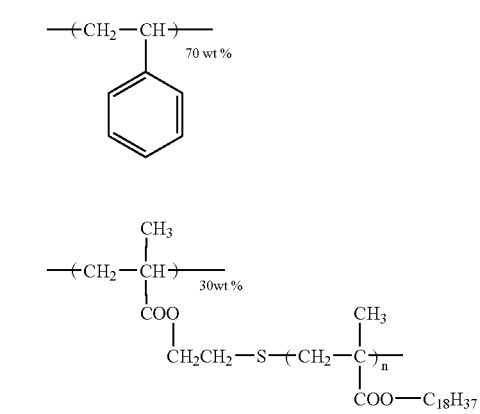

[BZ-3]

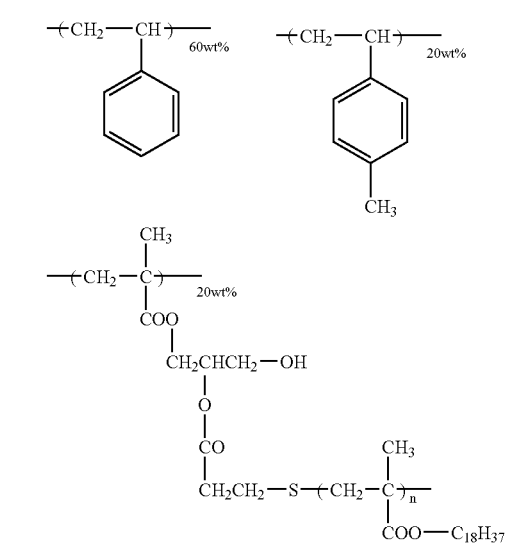

[BZ-4]

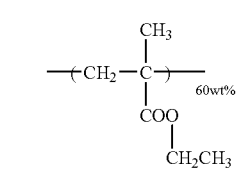

-continued

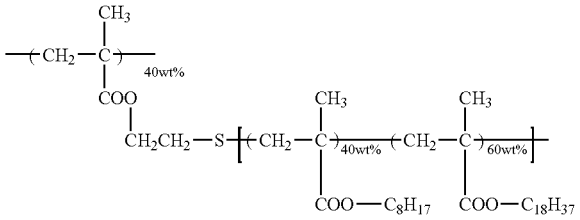

[BZ-5]

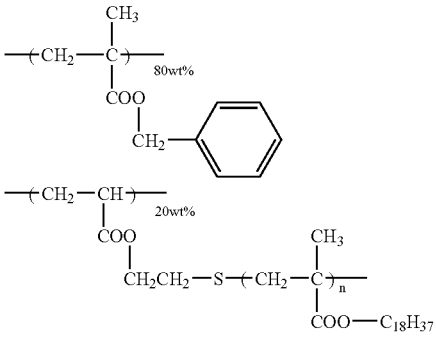

[BZ-6]

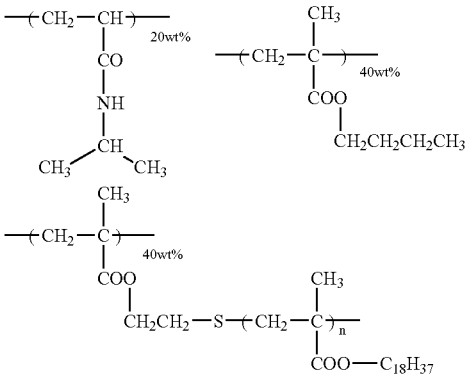

A graft polymer containing a polymer component containing at least one of the constituent units represented by the general formulae (5) and (6) and a polymer component containing at least the constituent unit represented by the general formula (7) as a graft chain may have only the constituent units represented by the general formula (5) and/or (6), and the general formula (7), or may contain other constituent components. The preferable composition ratio between the polymer component containing a graft chain and the other polymer components is 10:90 to 90:10. This range is preferable, since satisfactory particle forming property is obtained, and a desired particle diameter is likely to be obtained.

Each of those polymers may be used alone as a dispersant, or at least two kinds of them may be combined and used.

The content of the dispersant with respect to the entire ink Q is preferably 0.01 to 30% by weight. By setting the content of the dispersant in this range, satisfactory particle forming property is obtained, and a desired colorant particle diameter can be obtained.

By adding a charge regulator to the ink Q used in the present invention, the above-mentioned colorant particles dispersed in a dispersion medium preferably using a dispersant are charged.

Suitable examples of the charge regulator include: metallic salts of organic carboxylic acids such as naphthenic acid zirconium salt and octenoic acid zirconium salt; ammonium salts of organic carboxylic acids such as stearic acid tetramethylammonium salt; metallic salts of organic sulfonic acids such as dodecylbenzenesulfonic acid sodium salt and dioctylsulfosuccinic acid magnesium salt; ammonium salts of organic sulfonic acids such as toluenesulfonic acid tetrabutyl ammonium salt; polymers each containing a carboxylic acid group in the side chain such as a polymer with a carboxylic acid group containing a copolymer of styrene and maleic anhydride modified by an amine; polymers each containing a carboxylic acid anion group in the side chain such as a copolymer of stearyl methacrylate and tetramethylammonium salt of methacrylic acid; polymers each containing a nitrogen atom in the side chain such as a copolymer of styrene and vinylpyridine; and polymers each containing an ammonium group in the side chain such as a copolymer of butyl methacrylate and N-(2-methacryloyloxyethyl)-N,N,N-trimethylammonium tosylate salt.

Furthermore, preferable examples of the charge regulator also include a polymer that is a polymer compound obtained by the reaction of a copolymer having at least one monomer soluble in a non-aqueous solvent and maleic anhydride as constituent units, and a primary amino compound or a primary amino compound and a secondary amino compound, and that has half-maleic acid amide component and a maleinimide component as repeating units. This charge regulator is described in detail in the specification of commonly assigned Japanese Patent Application No. 2003-51021.

The charge regulator is preferably a polymer, and particularly preferably a polymer containing a carboxylic acid group.

In the ink Q used in the present invention, the charge provided to colorant particles by the charge regulator may be positive or negative.

Furthermore, in the ink Q used in the present invention, there is no limit to the content of the charge regulator. However, it is preferable that the amount of the charge regulator with respect to the entire ink Q be in the range of 0.0001 to 10% by weight. In this range, the electric conductivity of the ink Q can be easily regulated in the range of 10 to 10,000 nS/m, and the mobility of the colorant particles (charge particles) can be regulated easily in the range of $0.1\times10^{-9}$ to $1{,}000\times10^{-9}$ $m^2/V\cdot s$.

The ink Q used in the present invention may contain various kinds of components such as a preservative for preventing decomposition, a surfactant for controlling the surface tension, etc., as well as a dispersion medium, colorant particles, a dispersant, a charge regulator as described above, depending upon purposes.

Next, an electrostatic inkjet recording method of the present invention will be described in detail by illustrating the function of ejection of ink droplets R in the recording apparatus 10.

In the following example, the colorant particles dispersed in the ink Q are positively charged. Thus, the first control electrodes 36 and the second control electrodes 38 are supplied with a positive voltage so that the ink droplets R are ejected, and the recording medium P is charged to a negative bias voltage.

During recording of an image, the ink Q circulates in the ink flow path 26 at a predetermined speed from the right side to the left side in FIG. 1B (in a direction represented by an arrow a in FIG. 1B) by virtue of an ink circulation mechanism (not shown).

On the other hand, while the recording medium P is charged to a negative high voltage (e.g., −1,500 V) by the charging unit 16, and is electrostatically attracted and adhere to the insulating sheet 52 of the holding means 14, the recording medium P is transported to the back side in the figure, for example, by transportation means (not shown).

As descried above, in this embodiment, the first control electrodes 36 are driven by pulse modulation on a column basis in accordance with image data, and in the second control electrodes 38, each row constituting a unit recording row is sequentially driven by time division. More specifically, in this embodiment, the driving frequency of the control electrodes for ejecting the ink droplets R is the driving frequency of the first control electrodes 36. When the first control electrodes 36 and the second control electrodes 38 are supplied with a pulse voltage, ejection is in an ON state. When even one of the first control electrode 36 and the second control electrode 38 is not supplied with a pulse voltage, ejection is in an OFF state.

Figure 3A:
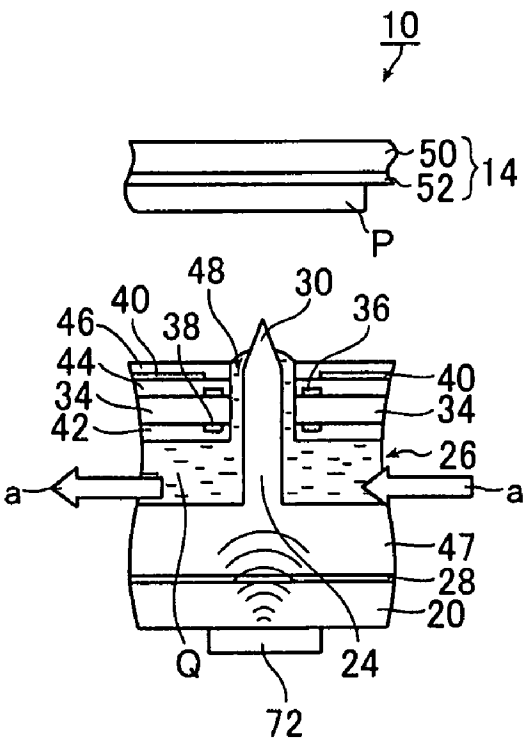
FIGS. 3A to 3C are conceptual diagrams illustrating the inkjet recording method of the present invention.

When none of the first control electrodes 36 and the second control electrodes 38 is supplied with a pulse voltage, i.e., when only a bias voltage is applied thereto, Coulomb attraction between the bias voltage and a charge of colorant particles of the ink Q, the Coulomb repulsion between the colorant particles, the viscosity, surface tension, dielectric polarization of carrier liquid, and the like act on the ink Q. In addition, owing to the linkage of these factors, the colorant particles and the carrier liquid move to form a meniscus slightly protruding upward from the nozzle 48 to keep balance, as conceptually shown in FIG. 3A.

Furthermore, the colorant particles move by so-called electrophoresis toward the recording medium P charged to a bias voltage owing to the Coulomb attraction and the like. That is, in the meniscus of the nozzle 48, the ink Q is concentrated.

From this state, a pulse voltage (driving pulse voltage) for ejecting the ink droplets R is applied (ejection is ON). That is, in the illustrated example, the first control electrodes 36 and the second control electrodes 38 are supplied with a pulse voltage of about 100 to 600 V from the pulse sources 37, 39 corresponding respectively to the first and second control electrodes 36 and 38, whereby both the electrodes are driven.

Figure 3B:
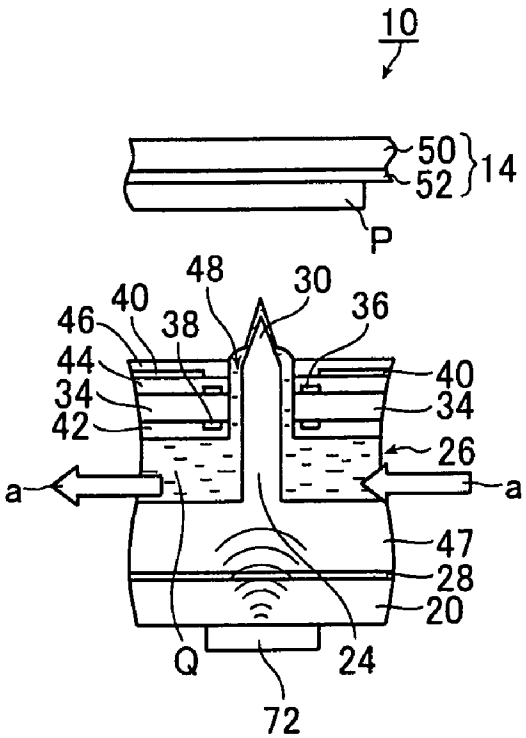

Because of the above, a pulse voltage is superimposed on a bias voltage, the movement caused by the superimposition of the pulse voltage on the bias voltage occurs in the above-mentioned linkage, the colorant particles and carrier liquid are attracted to the bias voltage (electrode substrate) side, i.e., the recording medium P side by electrophoresis, a meniscus grows as conceptually shown in FIG. 3B, and an ink liquid column (so-called Taylor cone) in a substantially conical shape is formed from an upper portion of the meniscus. Furthermore, as in the above, the colorant particles move to a meniscus by virtue of electrophoresis, and the ink Q of the meniscus is concentrated and substantially in a uniform high concentration, having a number of colorant particles.

Figure 3C:
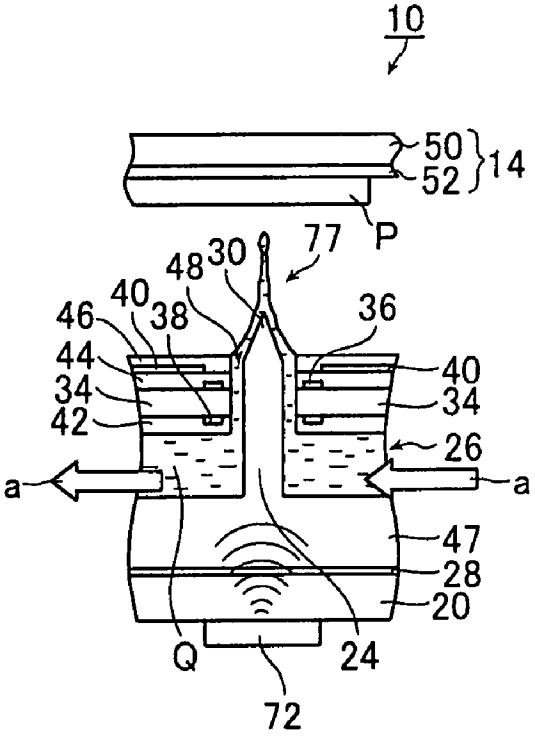

When a finite time elapses after the start of the application of a driving pulse voltage, the balance mainly between the Coulomb attraction acting on the colorant particles and the surface tension of the carrier liquid is lost at a tip end portion of the meniscus having high electric field intensity, owing to the movement of the colorant particles, and the like. Then, the meniscus extends upward rapidly, whereby a narrow long ink liquid column 77 called a thread is formed as conceptually shown in FIG. 3C. When vibrations (i.e., stimulus) are given at a high frequency of 100 kHz to 800 kHz from the piezoelectric element 72 as stimulus providing means under the condition that the thread 77 is formed, the thread 77 grows while being vibrated, or the intensity of the vibration amplitude is considered to increase owing to the resonance between the electrostatic force caused by the control electrodes or other external disturbance, and the vibrations caused by the piezoelectric element in a portion where the grown thread 77 is present. Because of this, the separation of the thread is considered to be promoted. The thread is separated at a plurality of positions by the vibrations. Then, the thread is separated at a plurality of positions into ink droplets R, which are then ejected, fly, are attracted to a bias voltage, and adhere to the recording medium P. In particular, the separation stability of the thread can be enhanced by setting the frequency generated by the piezoelectric element, i.e., the stimulus providing means at a Rayleigh-Weber frequency f satisfying the following equation:

$$f=v/\{8.89\times a\times(1+3\eta/(2\sigma\rho a)^{(1/2)})^{(1/2)}\}$$

where v[m/s] represents a fly speed at which liquid droplets fly from an ejection portion, a[m] represents the radius of the thread, η[Pa·s] represents the viscosity of ink, σ[N/m] represents the surface tension of ink, and ρ[kg/m$^3$] represents the density of ink.

The growth and separation of the thread continuously occur during the application of a driving pulse voltage. That is, while ejection is in an ON state and the thread is being formed, the thread is separated through the stimulus by the stimulus providing means, and the ink droplets R formed by the separation are ejected to fly toward the recording medium P. Furthermore, the movement of the colorant particles to the meniscus (thread) continues during the application of a driving pulse voltage. A large number of fine ink droplets R that flew by the application of one pulse voltage (one pulse) reach the recording medium P to form one dot of image. Thus, the ink droplets R ejected from the respective ejection portions reach predetermined positions of the recording medium P to form an image. Furthermore, since one dot of image is formed of a large number of fine ink droplets, an image is formed in a high gray-scale.

When the application of a driving pulse voltage is completed (ejection is in an OFF state), the force with which the colorant particles and the carrier liquid are attracted to the recording medium side decreases, which decreases the size of the formed thread. When a predetermined time elapses, the state returns to the meniscus shown in FIG. 3A in which only a bias voltage is applied to the recording material P.

The above-mentioned Rayleigh-Weber frequency f varies depending upon the physical properties of ink such as the viscosity, surface tension, and density of ink. Therefore, for example, in the case where recording is performed using ink of plural colors, it is desirable to adjust the physical properties of ink of the respective colors so that the value of the frequency f becomes the same. Because of this, if the stimulus at a constant frequency is given using the same stimulus providing means, the thread of ink formed through a nozzle corresponding to each color can be separated under substantially the same condition, so that liquid droplets of the respective colors can have the same size.

Furthermore, in the electrostatic inkjet recording method, the size of a thread of ink, the electric conductivity of an ink composition, the driving pulse voltage for controlling ejection, and the like influence the ejection of ink droplets, so that it is desirable to control them.

Figure 4:
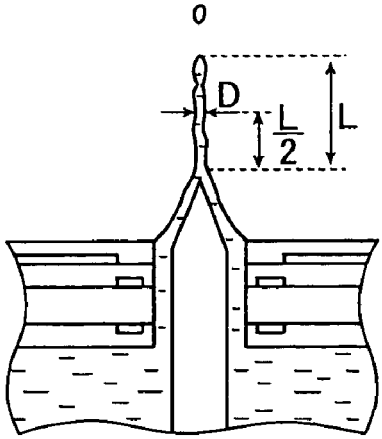
FIG. 4 is an enlarged view showing a circumference of an ink guide and a thread shown in FIG. 3C.

The size of a thread of ink can be represented in terms of the length and diameter of the thread. In the present invention, the length L of the thread is preferably 10 to 200 μm, and more preferably 20 to 70 μm. Furthermore, the diameter D thereof is preferably 3 to 20 μm, and more preferably 5 to 10 μm. It is assumed that the length L of the thread is a length from a tip end of a Taylor cone to a tip end of the thread as shown in FIG. 4, and does not include an ink droplet obtained by the separation. Furthermore, it is assumed that the diameter D is the diameter with respect to an intermediate point of the thread, i.e., the diameter with respect to an intermediate point between the tip end of the thread and the tip end of the Taylor cone.

According to the studies by the inventor of the present invention, the size of the thread varies depending upon the electric conductivity of an ink composition, the electric field intensity applied to the thread, the amount of ink supplied to an ejection portion, and the like. Thus, by appropriately selecting and setting the physical properties of the ink composition, driving pulse voltage, bias voltage, amount of ink supplied to the ejection portion, and the like, the size of the thread can be set within the above-mentioned range.

It is preferable to use an ink composition having an electric conductivity of 10 to 100,000 pS/cm, and it is more preferable to use an ink composition having an electric conductivity of 100 to 10,000 pS/cm.

The driving pulse voltage for controlling ejection is preferably 1,000 V or less, and more preferably 500 V or less. Herein, the driving pulse voltage is a voltage that gives an ON state or an OFF state of ejection. In this embodiment having a two-layered electrode structure in which matrix driving is performed, the driving pulse voltage refers to a pulse voltage applied to both the first control electrodes 36 and the second control electrodes 38.

In the illustrated head 12, as another embodiment, the first control electrodes 36 and the second control electrodes 38 can also be driven in an opposite state. That is, it is also possible to drive the first control electrodes 36 sequentially on a column basis, and the second control electrodes 38 in accordance with image data.

In this case, in the column direction, the first control electrodes 36 are driven on a column basis, and the first control electrodes 36 of the ejection portions on both sides of the respective central ejection portions in the column direction are always at a ground level. Therefore, the first control electrodes 36 of the ejection portions in the columns on both sides serve as the guard electrodes 40. Thus, in the case where each column is sequentially turned on by the first control electrodes 36 in an upper layer, and the second control electrodes 38 in a lower layer are driven in accordance with image data, even when the guard electrodes 40 are not provided, the influence of the adjacent ejection portions is eliminated, and recording quality can be enhanced.

In the head 12, there is no particular limit as to whether the ejection/non-ejection of ink is controlled by one of the first control electrode 36 and the second control electrode 38, or both the electrodes. That is, the voltages on the control electrode side and the recording medium P side may be appropriately set so that, in the case where the difference between the voltage value at a time of ejection/non-ejection of ink on the control electrode side and the voltage value on the recording medium P side is larger than a predetermined value, ink is ejected, and in the case where the difference is smaller than the predetermined value, ink is not ejected.

Furthermore, in this embodiment, the colorant particles in ink are positively charged, and the recording medium side is charged to a negative high voltage. However, the present invention is not limited thereto. The colorant particles in ink may be negatively charged, and the recording medium P side may be charged to a positive high voltage. Thus, in the case where the polarity of the colorant particles is made opposite to that in the above-mentioned embodiment, the polarities of the voltages applied to the charging unit 16 of the recording medium P, and the first control electrodes 36 and the second control electrodes 38 of the respective ejection portions may be made opposite to those in the above example.

The inkjet recording method of the present invention has been described in detail, but the present invention is not limited to the above embodiment. Needless to say, various alterations and modifications can be made to the present invention without departing from the scope of the present invention.

EXAMPLE 1

Hereinafter, an example of the inkjet recording apparatus according to the present invention will be described.

In this example, the inkjet recording apparatus shown in FIGS. 1A and 1B was driven, whereby the diameter and length of a thread formed from nozzles of the inkjet head toward a recording medium, and the diameter, amount, and fly speed of a droplet formed by the separation of a thread were measured respectively. Ink to be ejected from the inkjet head was obtained by using Isopar G as a dispersion medium, and adjusting the electric characteristics of a dispersion prepared by dispersing a mixture containing a pigment and resin in a dispersant, by using a charge regulator. The particle concentration of the ink was 7[wt %], the conductivity thereof was 700[pS/cm], the viscosity thereof was 1.44[cP] (1.44[mPa·s]), and the surface tension thereof was 23[mN/m].

In driving the head, a bias voltage to be applied to the electrode substrate was set to be −1,500[V], and the first control electrodes and the second control electrodes were supplied with a pulse voltage of 700[V] at a driving frequency of 5[kHz]. The frequency of vibrations to be caused from a piezoelectric element was set to be 632[kHz]. The distance (gap) from the ink guide tip end to a material to be recorded was 500 [μm]. The diameter of a thread formed by driving the head under these conditions was 7 [μm], and the length thereof was 63 [μm]. Furthermore, the diameter of each droplet was 9 [μm], the amount of the droplets was 0.4 [pl], and the fly speed thereof was 22 [m/s].

Herein, the diameter and length of a thread, and the diameter of a droplet were obtained by: photographing an ejection phenomenon with a strobe optical observation system or a high-speed camera; and thereafter, actually measuring them from the photographed image. Furthermore, the amount of the droplets were obtained by converting the droplet diameter measured according to the above procedure. Furthermore, the fly speed was obtained by: photographing an ejection phenomenon at two times (that is, photographing at a predetermined interval) with the above-mentioned strobe optical observation system or high-speed camera; and calculating the speed based on the difference in position of droplets (movement distance of droplets) appearing on the photographed image, and a photograph time interval.

Furthermore, when an image was formed on a recording medium under the above-mentioned conditions, much finer ink droplets than before were ejected stably at a high speed, whereby a high resolution image was formed on the recording medium.

COMPARATIVE EXAMPLE 1

Next, ink having the same physical property values as those in Example 1 except the conductivity of 330 was used, and the inkjet head was driven as in Example 1 except that the oscillation frequency was set to be 65 kHz. Then, the diameter and length of a thread formed from the nozzles of the inkjet head toward the recording medium, and the diameter, amount, and fly speed of droplets formed by the separation of the thread were measured respectively as in Example 1.

As a result of the measurement, the diameter of the thread was 15 [μm], the length thereof was 182 [μm], the droplet diameter was 16 [μm], the droplet amount was 2.3 [pl], and the fly speed was 5 [μm/s]. When an image was formed on a recording medium by driving the inkjet head under the above-mentioned conditions, the resolution decreased compared with Example 1. This is because the diameter and length of the thread, and the diameter and amount of droplets increased, leading to an increase in the diameter of a dot formed on the recording medium. Furthermore, it was found that there was a shift in position where dots were formed on the recording medium. This is because the fly speed decreased to 5 [μm/s], which is lower than the case of Example 1, and the droplets ejected from the ejection portions of the inkjet head were influenced by the air resistance, whereby the landing positions of the droplets onto the recording medium were shifted.

What is claimed is:

1. An inkjet recording method in which droplets made of an ink composition are ejected to record on a recording medium, comprising:

using insulating ink prepared by dispersing colorant particles capable of being charged in a solvent as said ink composition;

allowing an electrostatic force to act on said ink composition to form a thread of said ink composition; and providing a stimulus to said thread at a frequency in a range of 100 kHz to 800 kHz to separate said thread into said droplets.

2. The inkjet recording method according to claim 1, wherein an equation:

$$f=v/\{8.89\times a\times(1+3\eta/(2\sigma\rho a)^{(1/2)})^{(1/2)}\}$$

is satisfied assuming that said frequency is f[Hz], a fly speed of said droplets is v[m/s], a radius of said thread is a[m], a viscosity of said ink composition is η[Pa·s], a surface tension of said ink composition is σ[N/m], and a density of said ink composition is ρ[kg/m$^3$].

3. The inkjet recording method according to claim 1, wherein said stimulus comprises vibrations generated by using one of a piezoelectric element, a magnetostrictor, and an electrostatic actuator.

4. The inkjet recording method according to claim 1, wherein said stimulus comprises heating with a heater that generates heat periodically.

5. The inkjet recording method according to claim 1, wherein said stimulus comprises application of a high-frequency voltage at said frequency so that said high-frequency voltage is superimposed on one of a control voltage applied for controlling ejection of said droplets and a charging voltage applied for charging said recording medium with an opposite polarity to that of said control voltage.

6. The inkjet recording method according to claim 1, wherein, when at least two kinds of ink compositions that are different from each other are used as said ink composition, physical properties of said at least two kinds of ink compositions are previously adjusted so that frequencies of said stimulus becomes identical.

7. An inkjet recording apparatus in which an electrostatic force is allowed to act on an ink composition to eject ink droplets, thereby recording on a recording medium, comprising:

an inkjet head which is placed at a position where said inkjet head is opposed to said recording medium, and which includes ejection ports through which said ink droplets are ejected and control electrodes for applying control voltages for allowing said ink droplets to be ejected;

an electrode substrate placed on a side of said recording medium opposite to a side facing said inkjet head, for applying a charging voltage with a polarity opposite to that of said control voltages to said recording medium; and stimulus providing means for providing a stimulus at a frequency in a range of 100 kHz to 800 kHz to threads of said ink composition formed from said ejection ports toward said recording medium by electric forces generated from said control electrodes.

8. The inkjet recording apparatus according to claim 7, wherein said stimulus providing means provides said stimulus at said frequency f[Hz] satisfying an equation:

$$f=v/\{8.89\times a\times(1+3\eta/(2\sigma\rho a)^{(1/2)})^{(1/2)}\}$$

where a fly speed at which said ink droplets fly from one of said ejection ports is v[m/s], a radius of one of said threads formed from said one of said ejection ports is a[m], a viscosity of said ink composition is η[Pa·s], a surface tension of said ink composition is σ[N/m], and a density of said ink composition is ρ[kg/m$^3$].

9. The inkjet recording apparatus according to claim 7, wherein said stimulus providing means comprises one of a piezoelectric element, a magnetostrictor, and an electrostatic actuator provided in said inkjet head.

10. The inkjet recording apparatus according to claim 7, wherein said stimulus providing means comprises a heater that generates heat periodically.

11. The inkjet recording apparatus according to claim 7, wherein said stimulus providing means comprises a high-frequency power source for applying a voltage at said frequency so that said voltage is superimposed on one of said control voltages and said charging voltage.

12. The inkjet recording apparatus according to claim 7, wherein said inkjet head includes respective ink guides extending through said ejection ports.

* * * * *